US012227333B2

(12) United States Patent
Freirich et al.

(10) Patent No.: US 12,227,333 B2
(45) Date of Patent: Feb. 18, 2025

(54) ILLUSION CONTAINER ASSEMBLY AND METHOD

(71) Applicants: Mike Freirich, Klamath Falls, OR (US); Shelley Freirich, Klamath Falls, OR (US)

(72) Inventors: Mike Freirich, Klamath Falls, OR (US); Shelley Freirich, Klamath Falls, OR (US)

( * ) Notice: Subject to any disclaimer, the term of this patent is extended or adjusted under 35 U.S.C. 154(b) by 143 days.

(21) Appl. No.: 18/095,574

(22) Filed: Jan. 11, 2023

(65) Prior Publication Data

US 2024/0228114 A1 Jul. 11, 2024

(51) Int. Cl.
*B65D 25/06* (2006.01)
*B65D 43/02* (2006.01)

(52) U.S. Cl.
CPC ..... *B65D 25/06* (2013.01); *B65D 43/0222* (2013.01); *B65D 2543/00537* (2013.01)

(58) Field of Classification Search
CPC ..... B65D 25/06; B65D 43/0222; B65D 2543/00537; B65D 5/48026; B65D 5/12
See application file for complete search history.

(56) References Cited

U.S. PATENT DOCUMENTS 1,859,401 A * 5/1932 Lengsfield ..... B65D 5/5213 217/11
2,402,062 A 6/1946 Magill
2,498,757 A 2/1950 High
2,564,122 A 8/1951 Mele
4,955,470 A 9/1990 Hamel
5,120,263 A * 6/1992 Ierfino ..... A63H 13/16 273/459
5,172,806 A * 12/1992 Mickelberg ..... B65D 5/4204 206/769
5,919,074 A * 7/1999 Honda ..... B65D 5/5028 446/268
6,749,437 B2 * 6/2004 Chan ..... B65D 5/4291 446/72
6,755,306 B2 * 6/2004 Maus ..... B65D 5/5405 206/774
7,641,052 B2 * 1/2010 Calendrille, Jr. .... B65D 5/4204 206/779
D939,180 S 12/2021 Barber
2003/0146130 A1 * 8/2003 Kanter ..... B65D 5/3621 206/774
2005/0061863 A1 * 3/2005 Quaintance ..... B65D 5/0075 229/199

* cited by examiner

*Primary Examiner* — Kareen K Thomas

(57) ABSTRACT

A illusion container assembly and method for hiding at least one object using a false bottom includes a box having a bottom wall and a perimeter edge. A perimeter wall is coupled to the perimeter edge and extends upwardly from the bottom wall. A top edge of the perimeter wall defines an opening into an interior space of the box. A lid is removably mounted to the opening of the box, thus the lid removably encloses the interior space of the box. A panel is removably positioned within the interior space of the box to enclose a hidden space from the bottom wall to the panel. A support is removably positioned within the hidden space and facilitates spacing the panel from the bottom wall.

1 Claim, 5 Drawing Sheets

ILLUSION CONTAINER ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to boxes and more particularly pertains to a new box for hiding at least one object using a false bottom.

(2) Description of Related Art Including Information Disclosed Under 37 CFR 1.97 and 1.98

The prior art relates to boxes and includes a variety of boxes having a false bottom to conceal a hidden compartment or space. Known prior art does not include a box having a support being removably positioned within the hidden compartment or space to increase a space containing at least one object.

BRIEF SUMMARY OF THE INVENTION

An embodiment of the disclosure meets the needs presented above by generally comprising a box including a bottom wall having a perimeter edge. A perimeter wall is coupled to the perimeter edge and extends upwardly from the bottom wall. A top edge of the perimeter wall defines an opening into an interior space of the box. A lid is removably mountable to the opening of the box, wherein the lid removably encloses the interior space of the box. A panel is removably positioned within the interior space of the box to enclose a hidden space from the bottom wall to the panel. A support is removably positioned within the hidden space and facilitates spacing the panel from the bottom wall.

Another embodiment of the disclosure comprises a method including the steps of removing a lid from an opening of a box and positioning at least one object on a bottom wall of the box thereafter. A plurality of members of a support is placed around at lease one object on the bottom wall. A panel is positioned upon the support, wherein the panel encloses at least one object within a hidden space. the lid is positioned on the opening of the box thereafter.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
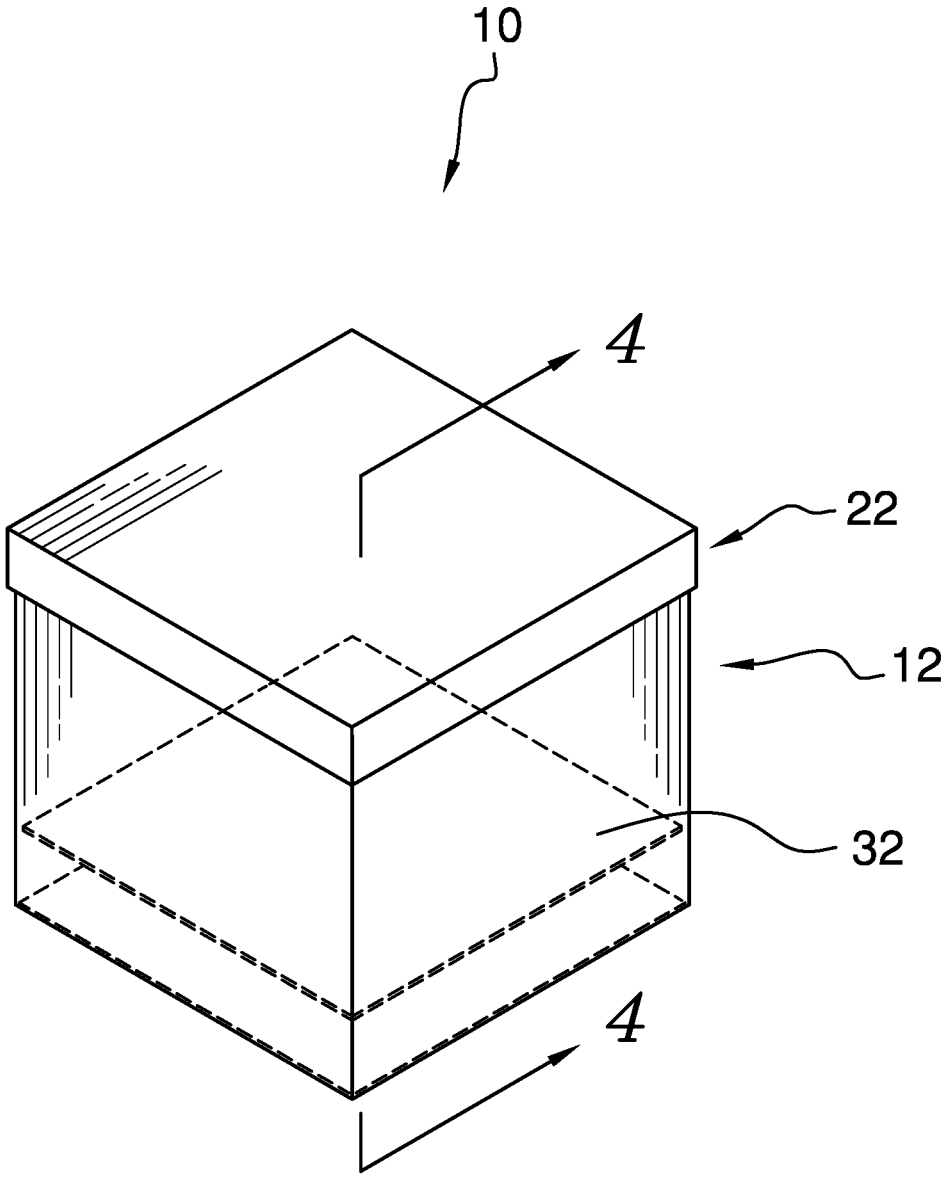
FIG. 1 is a top isometric view of an illusion container assembly according to an embodiment of the disclosure.
Figure 2:
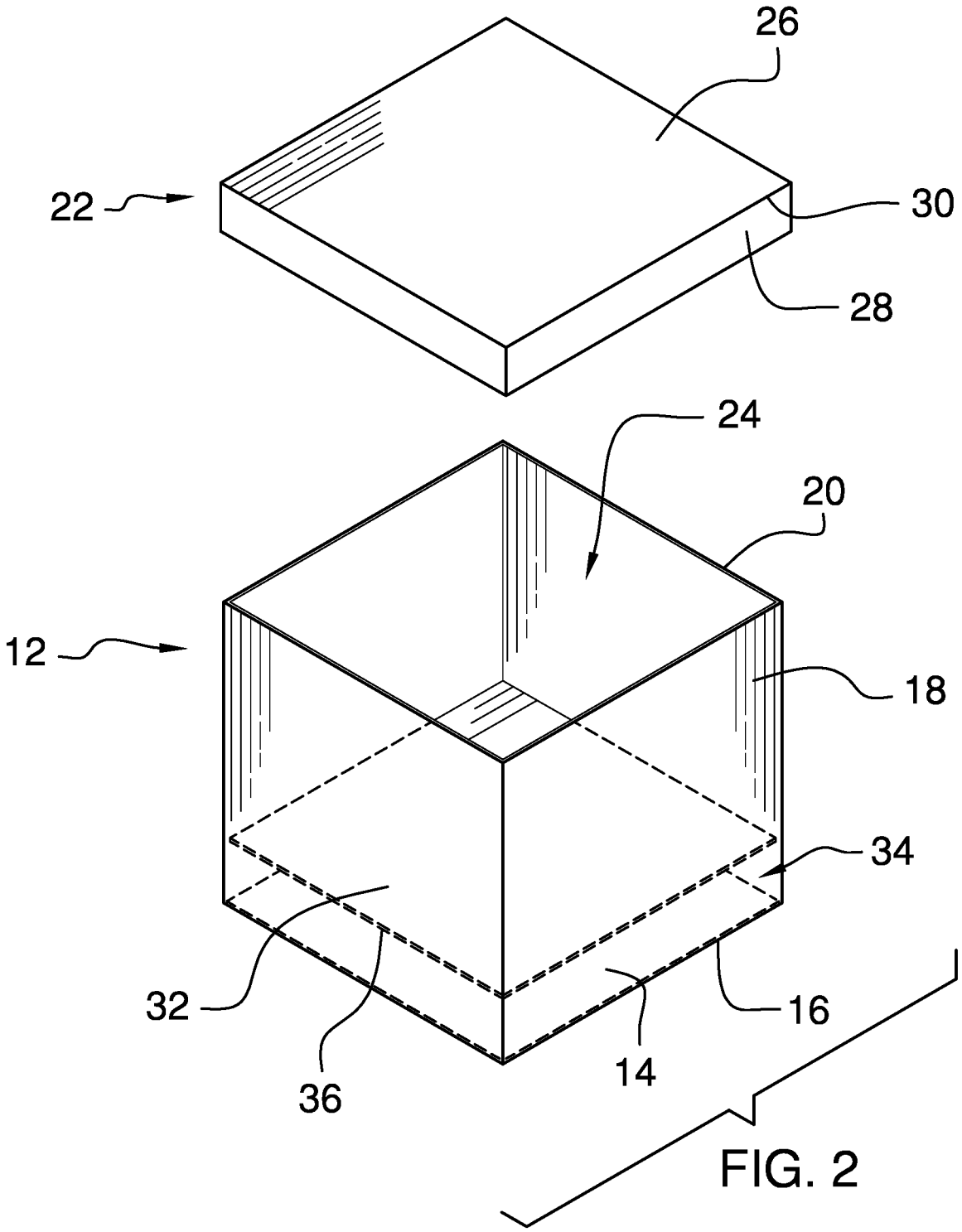
FIG. 2 is an exploded view of an embodiment of the disclosure.
Figure 3:
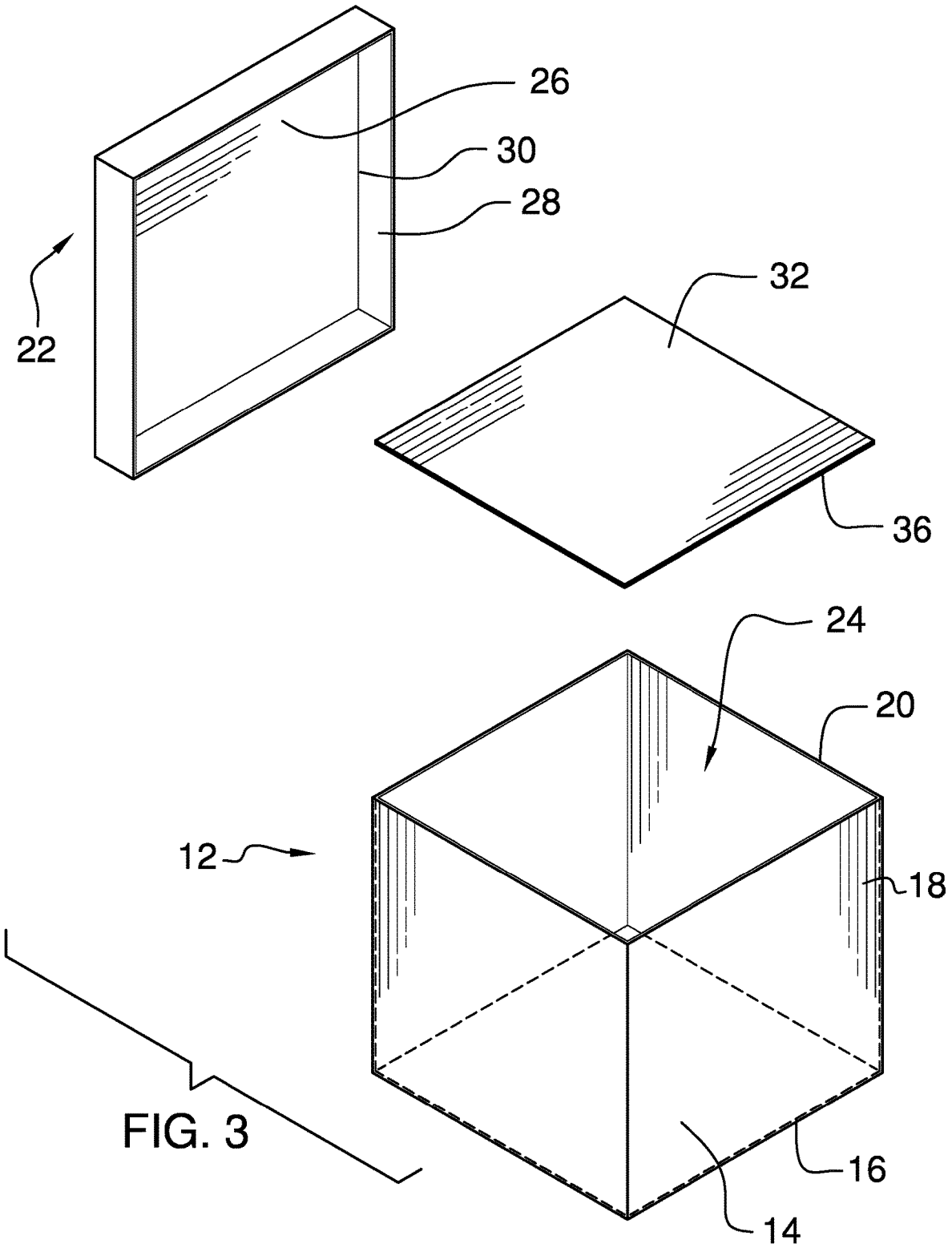
FIG. 3 is an exploded view of an embodiment of the disclosure.
Figure 4A:
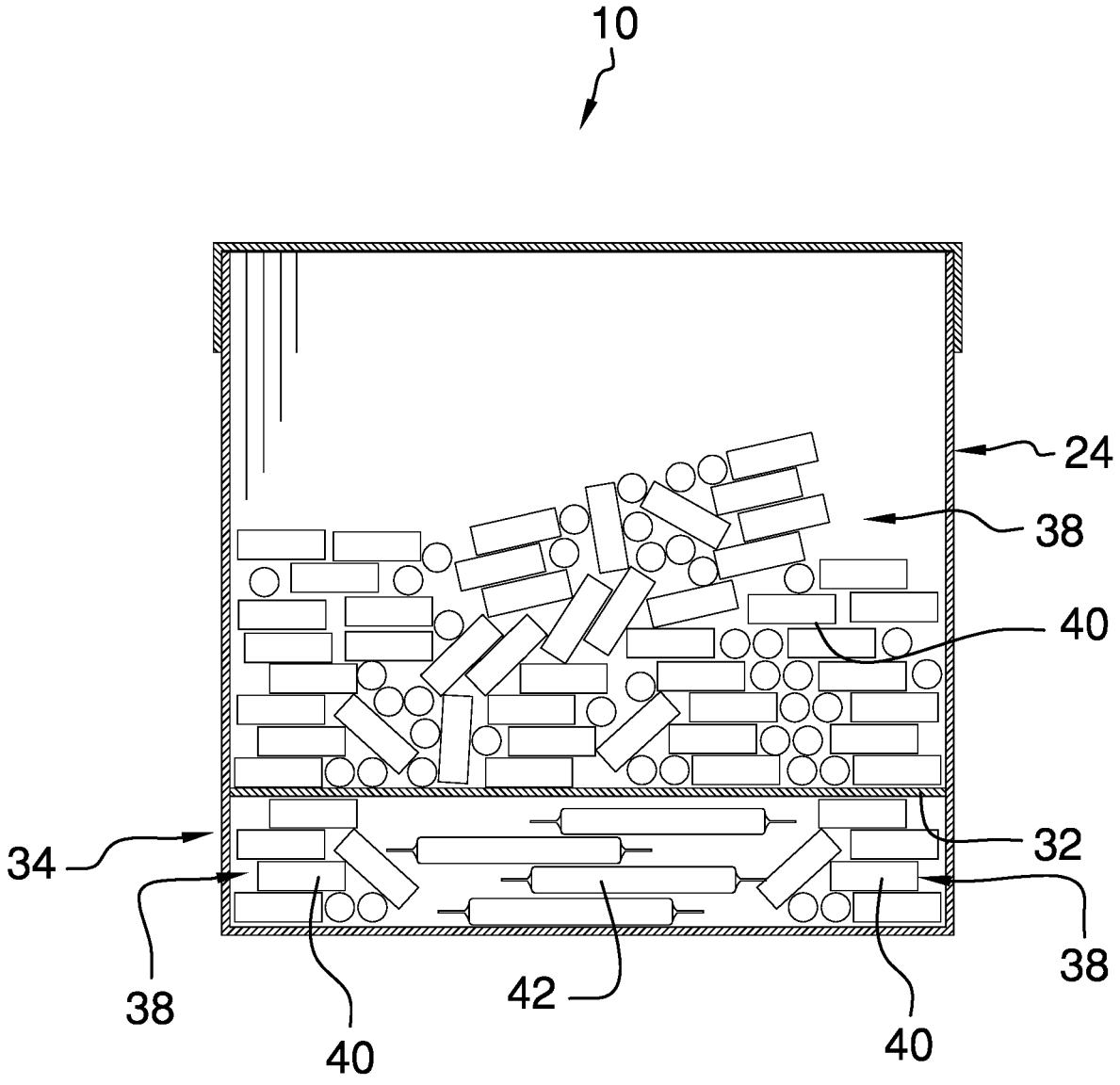
FIG. 4A is an in-use view of an embodiment of the disclosure.
Figure 4B:
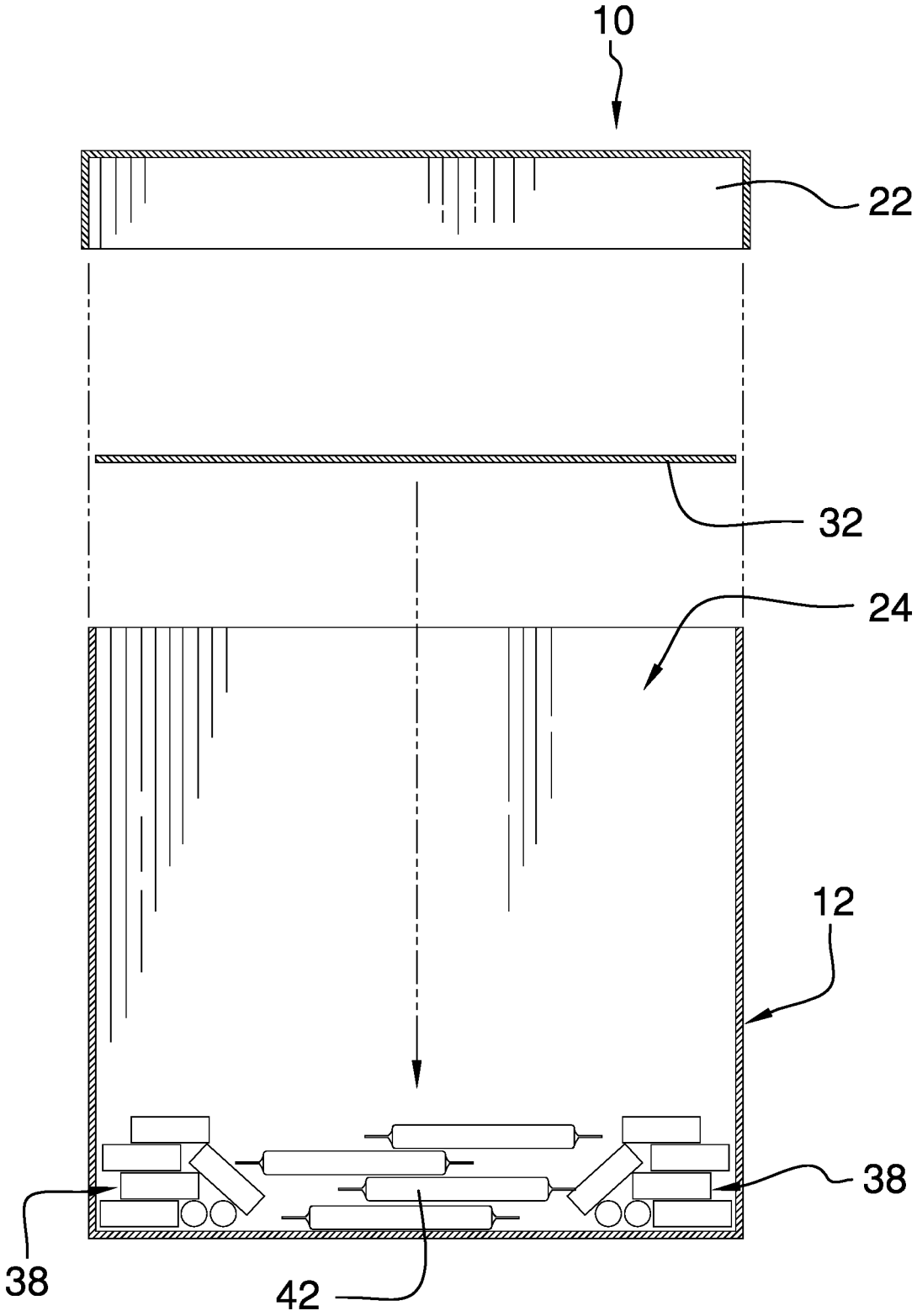
FIG. 4B is an in-use view of an embodiment of the disclosure.

With reference now to the drawings, and in particular to FIGS. 1 through 4 thereof, a new box embodying the principles and concepts of an embodiment of the disclosure and generally designated by the reference numeral 10 will be described.

As best illustrated in FIGS. 1 through 4, the illusion container assembly and method 10 generally comprises a box 12 including a bottom wall 14 having a perimeter edge 16. A perimeter wall 18 is coupled to the perimeter edge and extends upwardly from the bottom wall 14. The perimeter wall 18 typically comprises a square shape such that the box 12 typically comprises a cubic shape. A top edge of the perimeter wall 14 defines an opening 20 into an interior space of the box 12. The box 12 typically will comprise a resiliently bendable material such as cardboard.

A lid 22 is removably mountable to the opening 20 of the box 12, wherein the lid 22 removably encloses the interior space 24 of the box 12. The lid 22 may include a top wall 26 and a boundary wall 28 coupled to a boundary edge 30 of the top wall 26 and extending downwardly from the top wall 26. The top wall 26 of the lid 22 will typically have a perimeter larger than the opening 20 of the box 12 such that the opening 20 of the box 12 fits between the boundary wall 28 when the lid 22 is positioned on the box 12

A panel 32 is removably positioned within the interior space 24 of the box 12 to enclose a hidden space 34 from the bottom wall 14 to the panel 32. The panel 32 has a outer edge 36 being abuttable to the perimeter wall 18 within the interior space 24 such that an entirety of the outer edge 36 abuts the perimeter wall 18 to inhibit visibility of the hidden space 34 to a person cursory viewing into the interior space 24 of the box 12. The panel 32 will typically comprise the same material as the box 12 to facilitate duping the person into perceiving the panel 32 as the bottom wall 14.

A support 38 is removably positioned within the hidden space 34 and facilitates spacing the panel 32 from the bottom wall 14. The support 38 may comprises a plurality of members 40 being removably positioned upon each other to increase or decrease a height from the bottom wall 14 to the panel 32. The members 40 are stacked on top of each other to increase room within the hidden space 34. Each member 40 normally comprises a resiliently compressible material such as packing foam or another conventional material used to provide support to items within a box.

In use, the lid 22 is removed from the opening of the box 12 and at least one object 42 is positioned on the bottom wall 14 within the interior space 24 of the box 12 thereafter. The object 42 may comprise a surprise gift for the person such as a candy bar or another conventional gift being positionable within the hidden space 34. The plurality of members 40 of the support 38 is placed around at lease one object 42 on the bottom wall 14. The panel 32 positioned upon the support 38, wherein the panel 32 encloses at least one object 42 within the hidden space 34. The plurality of members 40 of the support 38 may be positioned upon the panel 32 within the interior space 24, wherein the members 40 facilitate concealing the panel 32 from the person. The lid 22 is positioned on the opening of the box 12 thereafter. The box 12 is presented to the person who may remove the lid 22 from the box 12 prior to removing the members 40 from the interior space 24. The panel 32 may then be removed from the interior space 24 to reveal at least one object 42 within the hidden space 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An illusion container assembly comprising:

a box including a bottom wall having a perimeter edge, a perimeter wall being coupled to said perimeter edge and extending upwardly from said bottom wall, a top edge of said perimeter wall defining an opening into an interior space of said box;

a lid being removably mountable to said opening of said box, wherein said lid removably encloses said interior space of said box;

a panel being removably positioned within said interior space of said box to enclose a hidden space from said bottom wall to said panel, said panel having an outer edge being abuttable to said perimeter wall such that an entirety of said outer edge abutting said perimeter wall to inhibit visibility of said hidden space to a person cursory viewing into said interior space of said box; and a support being removably positioned within said bidden space and facilitating spacing said panel from said bottom wall, said support comprising a plurality of members being removably positioned upon each other to increase or decrease a height from said bottom wall to said panel, each member comprising a resiliently compressible material.

* * * * *